United States Patent [19]

Klein

[11] Patent Number: 4,949,682

[45] Date of Patent: Aug. 21, 1990

[54] PARTICULATE AND DIRT COLLECTING INDICATOR, DEFLECTOR AND COLLECTOR FOR AN AUTO COOLANT SYSTEM

[76] Inventor: Michael E. Klein, 5715 Jamison Ave. NE., St. Michael, Minn. 55376

[21] Appl. No.: 374,361

[22] Filed: Jun. 30, 1989

[51] Int. Cl.[5] ..... F01P 5/14

[52] U.S. Cl. ..... 123/41.15; 210/167; 210/320; 210/803; 165/119

[58] Field of Search ..... 123/41.14, 41.15, 198 E, 123/41.55; 210/167, 305, 320, 801, 803; 165/119

[56] References Cited

U.S. PATENT DOCUMENTS

| | | | |
|---|---|---|---|
| D. 275,513 | 9/1984 | Johnson | D23/209 |
| 1,355,306 | 10/1920 | Brenkert | 210/103 |
| 1,832,776 | 11/1931 | Hudson | 123/41.15 |
| 1,857,606 | 5/1932 | Rendelman | 210/167 |
| 1,887,781 | 11/1932 | Parr | 210/167 |
| 2,011,031 | 8/1935 | Birch | 210/186 |
| 2,034,242 | 3/1936 | Mautner | 165/119 |
| 2,142,888 | 1/1939 | Donnallan | 210/167 |
| 2,488,806 | 11/1949 | Crowder | 210/167 |
| 3,362,536 | 1/1968 | Sellman | 210/167 |
| 3,372,807 | 3/1968 | Barnard | 210/305 |
| 4,271,016 | 6/1981 | Albertson | 210/167 |
| 4,343,353 | 8/1982 | Tsopelas | 165/119 |

*Primary Examiner*—Noah P. Kamen

*Attorney, Agent, or Firm*—Palmatier & Sjoquist

[57] ABSTRACT

The present deflector removes particulate matter such as aluminum chips, dirt, and sludge from the coolant flow of an auto coolant system by the creation of swirling, circular fluid flow against the direction of coolant flow and away from the hose conveying the coolant. The swirling, circular fluid flow or eddies slow both the rate of the flow of the coolant and the rate of flow of particulate matter, which allows the particulate to settle out of the main current flow into an oblique lower conduit section. The settled particulate matter is passively stored in the lower conduit section until removed by a threaded cap without flushing the coolant system.

20 Claims, 2 Drawing Sheets

PARTICULATE AND DIRT COLLECTING INDICATOR, DEFLECTOR AND COLLECTOR FOR AN AUTO COOLANT SYSTEM

The present invention relates to dirt collecting devices in coolant systems and, more particularly, to particulate and dirt collecting indicators, deflectors and collectors in auto coolant systems.

BACKGROUND OF THE INVENTION

The collection of dirt and other particulates in an auto coolant system may be traced to many sources. One of the conventional sources is rust, which may form on cast iron heads and other cast iron auto components. The rusted metal surfaces of such components may become scaled with rust and rusted flakes may break off and flow into and with the coolant.

Other typical sources of particulate matter include transmission fluid, oil and exhaust gases. Combustion gases may contribute significantly to the collection of dirt and sludge in the auto coolant system.

Aluminum is a more recent source of particulate matter with the introduction of lightweight, aluminum auto components such as engine blocks. Unfortunately, aluminum corrodes. Whether the aluminum auto component is a water pump or engine head, small pieces of aluminum may tear from or break off the aluminum surfaces of the components. Such a cavitation corrosion may become especially severe on hot aluminum heads, where shock waves facilitate the corrosion. The shock waves are caused when coolant boils intensely around the hot aluminum exhaust ports and the boiling bubbles collapse. The collapsing bubbles create the shock waves, which increase the aluminum corrosion. After the aluminum chips tear from the aluminum auto components, they flow into and with the coolant to damage other engine parts or may even return to damage the very component off of which they were torn.

Another source of particulate matter is solder. Solder may corrode by reacting with coolant or antifreeze with chemicals such as glycol and silicone, and create "solder bloom" particles.

Another type of particulate is created by an electrolysis like reaction between the coolant and the liners of the engine block. One product of the electrolysis reaction is a water salt or white calcium like deposit which may precipitate out of the coolant to be carried with the coolant flow to plug up or damage other automobile components.

Still another source of particulate matter is sand. After an engine block is sand casted, auto manufacturers often fail to remove all of the sand from the block. The sand which remains is picked up by coolant.

Aluminum chips, calcium and solder bloom particles, sand, rust, dirt and sludge and other particulate matter flowing in coolant may damage a great variety of auto components. For instance, such particulates may flow into and plug the tubes of the radiator or heater core. Furthermore, the particulates, especially the aluminum chips, may slowly eat holes from the water jacket into the combustion chamber.

Free flowing aluminum chips and other particulates may also impair other engine components such as the coolant temperature sensor. In computer-controlled engines, the sensor triggers a computer program that monitors fuel mixture, timing and idle speed, among other functions. The sensor typically includes probes or exposed leads extending into the coolant flow to sense the coolant temperature. Particulates flowing at high speed may damage or destroy the probes which may ultimately result in poor fuel economy and a less responsive engine.

Moreover, many cars include at least one more coolant sensor for controlling the spin of the coolant fan, which is typically slowed down at highway speeds when air flow through the radiator is adequate for cooling. The coolant fan sensors are typically disposed in the bottoms of radiators and are rendered inoperable by flowing aluminum chips or the buildup of dirt, sludge, rust and other deposits.

To remove particulate matter, it is standard practice to flush the entire auto coolant system. The system is typically completely drained, and new antifreeze and water are added. With older cars having cast iron components, a flush every two to three years is advised. With more modern cars having aluminum components, flushing is typically an annual event.

One of the ways to flush out a coolant system is to install a flushing T in the heater-inlet hose and connect a garden hose to the T. A disadvantage with such a technique is that the rate of water flow and the water pressure in a garden hose may be undesirably high and cause damage to automobile components such as the heater core.

SUMMARY OF THE INVENTION

A feature of the present invention in the provision in an auto coolant system, of an oblique conduit section affixed to an underside of a hose of the coolant system wherein a portion of an upstream side of the oblique conduit section creates an eddy or a rolling of coolant flowing across the conduit section so as to slow down the coolant flow and cause particulate matter to settle out of the coolant system and into the conduit section for removal.

Another feature of the present invention is the provision in an auto coolant system, of an oblique conduit section affixed to the underside of a hose of the coolant system wherein a downstream portion of the oblique conduit section extends into the coolant flow to create an eddy or swirling motion in the coolant flowing across the conduit section so as to cause particulate matter to drop out of the coolant system and into the conduit section for removal.

Another feature of the present invention is the provision in an auto coolant system, of a transparent, Y-shaped conduit section connectable in a hose of the coolant system wherein the conduit section includes a raised portion on the downstream portion of a collecting conduit section so as to create an eddy or turbulent coolant flow and cause particulate matter to slow down and settle out of the coolant system and into a lower conduit section for removal.

An advantage of the present invention is that particulate matter, including aluminum chips, calcium deposits, dirt and sludge is removed from the coolant flow of an auto coolant system without the aid of moving parts, filters or even an opening up of the normally closed auto coolant system.

Another advantage of the present invention is that it saves wear and tear on and extends the life of auto components such as the radiator, heater core, engine block and water pump by the removal of metal-eating, metal chips and other metal-eating and plugging debris without the opening up of the normally closed auto coolant system.

Another advantage of the present invention is that collected particulate matter is easily removed from the normally sealed auto coolant system by unscrewing a threaded cap portion and without flushing the system or removing any of the coolant.

Another advantage of the present invention is that the creation of a coolant eddy slows down the fluid so that particulate matter is perceivable through the transparent conduit section. Hence a car owner may readily determine the amount of particulate debris in his or her coolant system, as well as determine the color, flow or lack of flow in the system or whether other filters or components are working properly. Accordingly, the coolant is changed at appropriate intervals.

Another advantage of the present invention is that, if flushing is desired, the oblique conduit section facilitates a flushing and decreases the flow rate of the flushing fluid by the creation of eddies before the flushing fluid enters the coolant system.

Another advantage of the present invention is that it creates turbulence in the coolant and thereby aids in the dissipation of heat from internal combustion engines of automobiles, trucks, or heavy construction equipment.

Another advantage of the present invention is that it is simple and inexpensive to manufacture, install, operate and maintain. The deflector includes no working parts for replacement.

DETAILED DESCRIPTION OF THE PREFERRED EMBODIMENTS

Figure 1:
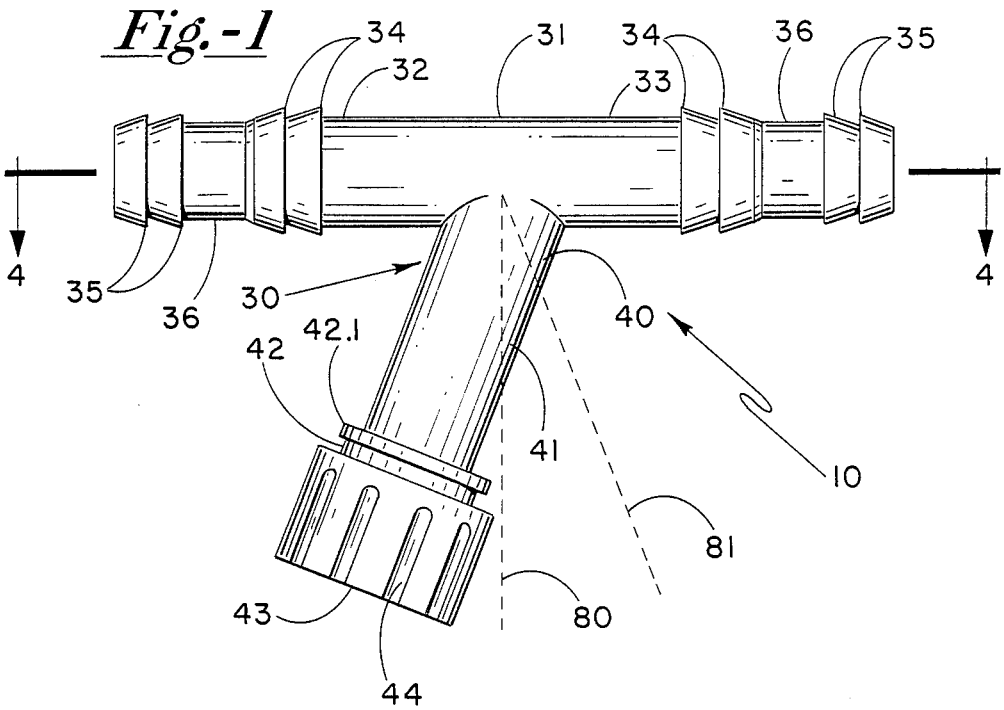
FIG. 1 shows an elevation view of the deflector.
Figure 2:
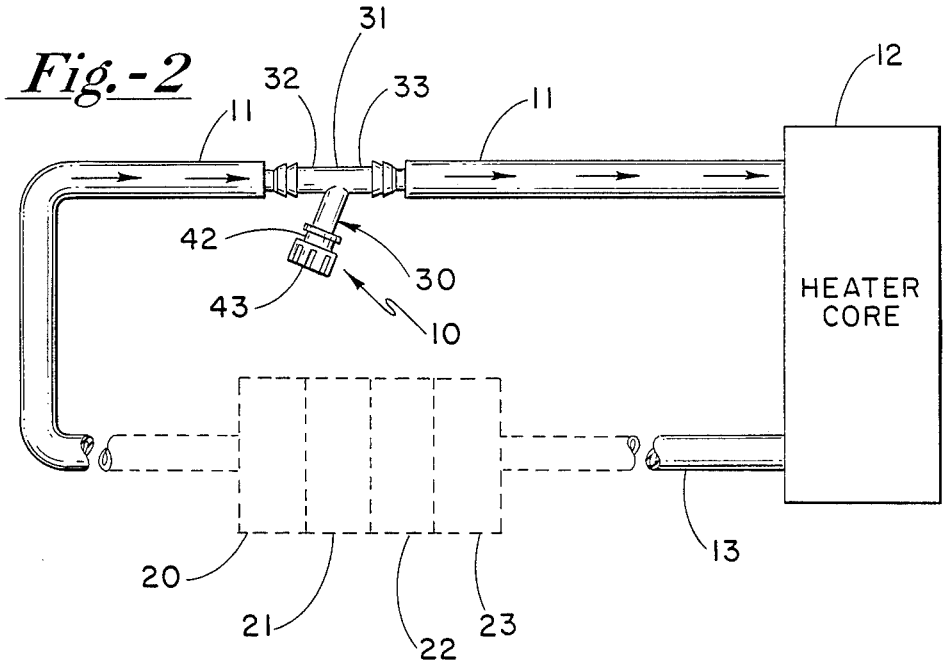
FIG. 2 shows the deflector of FIG. 1 connected in an auto coolant system.

As shown in FIGS. 1 and 2, a Y-shaped, particulate and dirt indicator, deflector and collector for auto coolant systems in automobiles, trucks, or heavy equipment is shown in general by the reference numeral 10. The reference 10 is typically connected to an inlet hose 11 of a heater core 12. However, it should be noted that the deflector 10 may be connected in an outlet hose 13 of the heater core 12 or in any other hose portion of an auto coolant system. For example, as shown in FIG. 2, the deflector 10 is connected in a hose portion conveying coolant to or away from engine components such as a radiator 20, water pump 21, engine block 22 or oil cooler 23. Furthermore, it should be noted that a number of deflectors 10 may be mounted in an auto coolant system.

Figure 3:
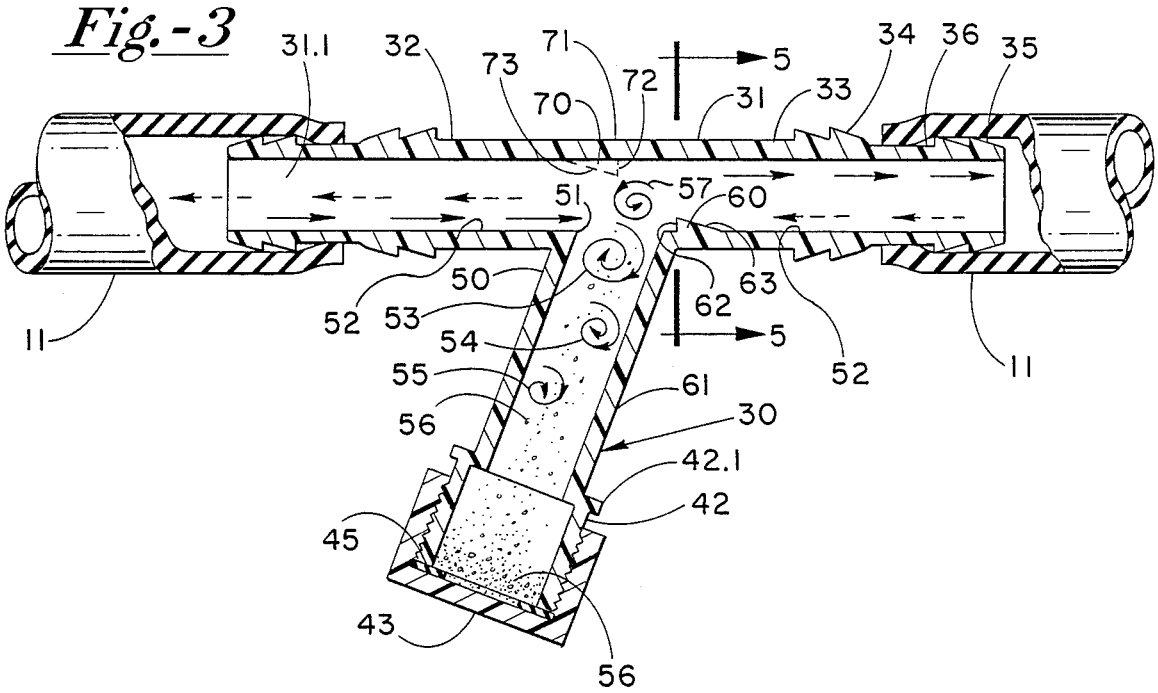
FIG. 3 shows a section view of the deflector of FIG. 1.

As shown in FIGS. 1, 2 and 3, the deflector 10 includes an oblique, downwardly extending, threaded, capped, transparent, particulate collecting, conduit section or deposit tube 30 integrally connected in an oblique orientation with a linearly disposed, barbed, transparent conduit section 31. Conduit section 31 defines a flow passage 31.1 and includes a pair of respective integral ends 32, 33. Each of the ends 32, 33 is integrally connected to a first inner pair of ring-like barbs 34 and a second outer pair of ring-like barbs 35 which are smaller in diameter than the first pair of barbs 34. Each of the barbed ends 32, 33 also includes an integral conduit section 36 disposed between the barbed sets 34, 35. Conduit sections 36 are smaller in diameter than main conduit section 31. Barbs 34, 35 accommodate coolant system hoses of different diameters so that one deflector 10 may be utilized in different coolant systems. Hose clamps are connectable to conduit sections 36 or to conduit section ends 32, 33.

As shown in FIGS. 1 and 2, the oblique conduit section 30 includes an upper end 40 integrally connected to the underside of the conduit section 31, a middle portion 41 integrally formed with an upper end 40 and a threaded, cup-like capped end 42 integrally formed with middle portion 41. Cup-like end 42 includes a boss 42.1 and has a larger diameter than middle conduit portion 41 or upper conduit end 40. The size of the cup-like end 42 may vary or a larger container may be affixed to end 42 so as to collect up to a pint or more of sludge or particulate matter.

A transparent threaded cooperating cap or collector 43 is threadable onto end 42 in a sealing relationship. The cap 43 may have grooves 44 to facilitate a gripping or manual operation of the cap 43. The cap 43 includes a rubber or plastic washer 45 to facilitate sealing between the cap 43 and lower conduit end 42. Excluding cap 43, the deflector 10 is molded in one piece from a nylon or nylon like material such as a nylon 330.

Figure 4:
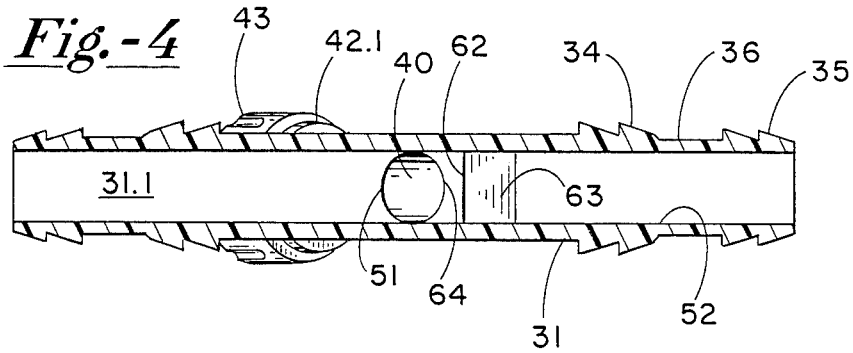
FIG. 4 shows a section view of the deflector at lines 4—4 of FIG. 1.
Figure 5:
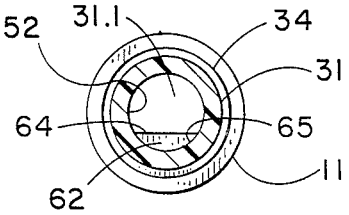
FIG. 5 shows a section view of the deflector at lines 5—5 of FIG. 3.

As shown in FIGS. 3, 4 and 5, an upstream side portion 50 of the upper end 40 of the conduit section 30 forms a spherical corner portion 51 with an underside portion 52 of conduit section 31. The corner 51 creates an eddy 53 in the coolant flow which may be disposed partially in the conduit section 31 and partially in the upper end 40. Smaller, less violent eddies 54, 55, as well as other eddies may be formed in the middle portion 41 of the conduit section 30. An eddy may be defined as a current of coolant moving contrary to the direction of the main current of coolant flow. The eddies 53, 54, 55 may be of a circular or random motion. If of circular motion, the eddies may be clockwise as shown in FIG. 3 or counter clockwise, such as eddy 57. As the eddies 53, 54, 55, 57 are formed, the rate of flow of the coolant particulate matter 56 is decreased. The eddies 53, 54, 55, 57 momentarily hold the particles 56 in a rolling, churning motion. The particulate matter 56 then drops out of the coolant and into collecting conduit end 42 of the conduit section.

As shown in FIGS. 3, 4 and 5, a raised portion 60 is integrally formed with the underside portion 52 on a downstream side portion 61 of the upper end 40 of conduit section 30. The raised portion 60 includes an upright wall 62 and a canted surface 63. Raised portion 60, alone or in combination with spherical corner portion 51, may create eddies 53, 54, 55, 57 or other similar eddies in the flow passage 31.1 or in the upper end 40 of conduit section 30. Upright wall 62 is typically spaced from a spherical corner portion 64 formed by side wall portion 61 of conduit section 30 and underside portion 52 of conduit section 31. The wall 62 includes an upper linear edge 64 which intersects with the inner wall of conduit section 31 to form an arc 65 of less then 180°. Raised portion 60 may facilitate the creation of eddies swirling in a counter clockwise direction relative the view shown in FIG. 3, such as eddy 57.

In operation, the deflector 10 is typically installed in the inlet hose 11 of the heater cord 12. The conduit section 30 is oriented so as to extend downwardly and upstream away from the heater cord 12. Hose clamps may be connected to either conduit sections 36 or conduit section 31. The cap 43 is threaded onto end 42 of conduit section 30 so as to provide a closed and sealed coolant system. Subsequently, the car in which the deflector 10 is installed may be operated in normal fashion.

As the car and coolant system are operated, the particulate matter 56 travels with the coolant from conduit section end 32 toward conduit section end 33. As the coolant flows over corner 51 and against raised portion 60, eddies 53, 54, 55, 57 or other similar eddies or swirls or turbulent flow is created. As the eddies 53, 54, 55, 57 are formed, coolant flow is decreased, and the rate of flow of particulate matter 56 is also decreased. Particulate matter 56 hence falls or settles out by gravity from conduit section 31 and into collecting end 42. Further coolant flow through conduit section 31, even when the water pump 21 is operating at high speed, fails to disturb or agitate the particulate matter 56 collected in end 42 and hence fails to carry the particulate 56 back into conduit section 31. As well as decreasing the rate of coolant and particulate flow, corner 51 directs the eddies 53, 54, 55 down into conduit section 56. Such directed particulates 56 may deflect off of the wall 61 to be directed into end 42. Since the raised portion 60 may facilitate the creation of eddy 57 which is swirling in an opposite direction to eddies 53, 54, 55, even more turbulence is created when the opposite flowing eddies, such as eddies 53 and 57, come into contact. Accordingly, the flow of coolant and particulate matter 56 is further decreased to allow even more particulate matter 56 to drop into the collector 43. Moreover, the upright wall 62 may act as an abutment for particulate matter 56 which may consequently be driven back toward and into conduit section 30.

With the coolant system operating, the transparent deflector or coolant eye 10 renders the state of the coolant readily perceivable. If conduit section 30 or its end 42 is filled with particulates 56, the cap 43 is unscrewed to remove the particulate 56 without flushing, or removing a significant portion of, the coolant system. If it is desired to flush the coolant system, a garden hose may be threaded on end 42.

The deflector 10 also slows down the rate of flow of the coolant and particulate 56 so that the particulates 56 are perceivable. It should be noted that even at high engine speeds, the eddies 54, 54, 55, 57 slow down the rate of coolant flow so that the particulates 56 are observable by the human eye.

It should be noted that one of the purposes for disposing the lower conduit section 30 at an acute angle relative upstream end 32 is to produce a gentler motion in middle portion 41 and end portion 42. If lower conduit section 30 is disposed at an obtuse angle relative upstream end 32, coolant may flow more easily into the lower conduit section 30 with less of an eddy effect. However, the deflector 10 is operable when the lower conduit section 30 is disposed at such an obtuse angle.

As shown in FIG. 3, in an alternate embodiment of the invention, a raised portion 70 is integrally formed with an upper side wall portion 71 of conduit section 31. The raised portion 70 includes an upright wall 72 and a canted end 73. The raised portion 70 is disposed so that upright wall 72 is oriented slightly downstream of the central portion of the spherical corner portion 51. Canted end 73 may aid in the creation of eddies and in directing particulate matter into conduit section 30.

As shown in FIG. 1, in other alternate embodiments of the invention, conduit section 30 may be disposed on one of the axes 80, 81. Axis 80 is disposed at a right angle in relation to conduit section 31. Axis 81 is set at a 70° angle relative downstream end 33 of conduit section 31. Furthermore, it should be noted that the deflector 10 is reversible, with coolant flowing from conduit section end 33 to conduit section end 32, as shown by the arrows drawn in phantom in FIG. 3.

It should be further noted that the length of middle portion 41 of the conduit section 30 may vary. With coolant systems having high flow rates, turbulence and eddies may be created further down conduit section 30. Accordingly, conduit section 30 may be lengthened to preclude agitation of collected particulates 56 and end 42 and a subsequent carrying of the particulates 56 out of conduit section 30 and back into conduit section 31.

It should further be noted that the deflector 10 is operable even without the raised portions 60 or 70 as corner portion 51 creates eddies 53, 54 and 55. Furthermore, the deflector 10 is operable with only raised portion 60 disposed in the coolant flow, with only raised portion 70 disposed in the coolant flow, or with both the raised portions 60, 70 disposed in the coolant flow. The deflector 10 is also reversible when the raised portions 60, 70 are disposed individually or in combination.

The length of conduit section 30 is typically two and one-half to three inches. The length of the conduit section 31, including conduit section 36 and barbs 34, 35 is typically five inches. The diameter of conduit sections 30, 31 is typically from one-half to five-eighth inches. Barbs 34, 35 are usually connected to hoses with three-quarter inch, and five-eighth inch diameters, respectively. Oblique conduit section 30 is typically disposed at 70° relative the upstream end 32 of the conduit section 31.

The height of each of the upright walls 62, 72 is typically 90/1000 of an inch. The distance between upright wall 62 and the inner edge of conduit wall 61 is typically 90/1000 of an inch.

Figure 6:
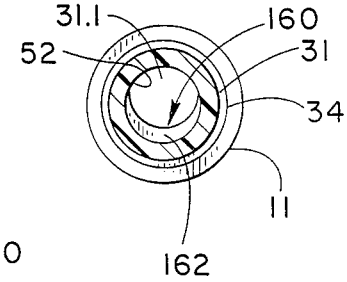
FIG. 6 shows an alternate embodiment of a conduit end of the deflector.

In an alternate embodiment of the invention as shown in FIG. 6, an eddy creating crescent like raised portion 160 is integrally formed with the conduit section 31 and extends into the flow passage 31.1. The raised portion 160 includes a crescent shaped upright wall 162 with a continuous canted surface similar to the canted surface 63 shown in FIG. 3.

Figure 7:
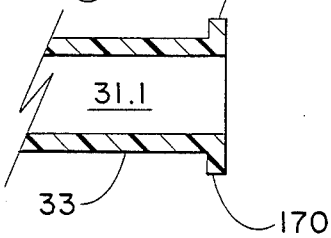
FIG. 7 shows an alternate embodiment of an eddy creating raised portion of the deflector.

In an alternate embodiment of the invention as shown in FIG. 7, each of the conduit ends 32, 33 may include an integral annular lip 170 instead of barbs 34, 35. The lip 170 is insertable in a coolant hose and a hose clamp is fastened to the conduit end 32 or 33 inwardly of the lip 170.

The present invention may be embodied in other specific forms without departing from the spirit or essential attributes thereof, and it is therefore desired that the present embodiment be considered in all respects as illustrative and not restrictive, reference being made to the appended claims rather than to the foregoing description to indicate the scope of the invention.

I claim:

1. A deflector for removing particulate matter from the coolant system of an internal combustion engine and being connectable in a hose of the coolant system, the deflector comprising:

an upper conduit section with inlet and outlet ends, the ends being connectable into the hose of the coolant system, the upper conduit section having an inner wall defining a flow passage, a lower conduit section with a lower end and depending from the upper conduit section, removable collector means connected to the lower end of the lower conduit section for collecting and removing particulate collected in the lower conduit section, a corner portion formed by the upper and lower conduit sections whereby the corner portion creates eddy like fluid flow to slow down the rate of fluid and particulate flow so that particulates settle into and are collected by the lower conduit section for removal, and the upper conduit section including a raised portion extending from the inner wall and partially into the flow passage to contribute to the eddy like fluid flow, the raised portion being disposed wholly between the outlet end and the corner portion.

2. The deflector of claim 1, wherein the lower conduit section is oriented obliquely relative the upper conduit section.

3. The deflector of claim 2, wherein the lower end of the lower conduit section is disposed at an acute angle relative the inlet end of the upper conduit section.

4. The deflector of claim 1, wherein the raised portion includes an upright wall for directing particulate matter back against the flow of fluid and into the lower conduit section.

5. The deflector of claim 4, wherein the upright wall includes an upper linear edge, the edge intersecting the inner wall to form an arc of less than 180°.

6. The deflector of claim 4, wherein the upright wall is crescent-shaped.

7. The deflector of claim 1, wherein the removable collector means includes a cap and wherein the lower end of the lower conduit section includes a threaded portion to receive and cooperate with the cap.

8. The deflector of claim 1, wherein the upper and lower conduit sections are integrally formed.

9. The deflector of claim 1, wherein the inlet and outlet ends of the upper conduit section include barbs for securing the deflector in the hose.

10. The deflector of claim 1, wherein the inlet and outlet ends of the upper conduit section include annular lips for securing the deflector in the hose.

11. The deflector of claim 1, wherein one of the conduit sections includes a transparent portion.

12. The deflector of claim 1, wherein the removable collector means includes a transparent portion.

13. The deflector of claim 1, wherein the upper conduit section includes a second eddy-creating portion disposed transversely of the raised portion, the second eddy-creating portion extending from the inner wall and partially into the flow passage to contribute to the eddy like fluid flow.

14. A deflector for removing particulate matter from the coolant system of an internal combustion engine and being connectable in a hose of the coolant system, the deflector comprising:

an integral, linearly disposed, upper conduit section with an upstream end, a downstream end and an underside, the ends including barbs for connecting the upper conduit section in the hose of the coolant system, an integral, obliquely disposed, lower conduit section integrally connected to the underside of the upper conduit section and having an upper end and a lower threaded cup-like end, the lower conduit section being disposed at an acute angle relative the upper conduit section, the upper end of the lower conduit section opening into the upper conduit section, a threaded removable cup-like cap connected to lower threaded end of the lower conduit section for sealing the deflector, the cap being removable from the lower end for the removal of collected particulate and dirt and for the connection of hose for flushing the coolant system, an eddy creating partially spherical corner portion formed by the underside of the upper conduit section and the upper end of the lower conduit section, and an eddy creating raised conduit portion formed in the downstream end of the upper conduit section and having an upright wall, the raised conduit portion integrally formed with the underside of the upper conduit section and extending into the flow of coolant, the upright wall being at substantially a right angle relative to the underside of the upper conduit section and spaced from the upper end of the lower conduit section whereby eddy-like fluid flow is created by the corner portion and raised portion to slow down coolant, dirt and particulate flow so that dirt and particulate settle out of the upper conduit section and fall into the lower end of the lower conduit section for removal from the coolant system.

15. The deflector of claim 14, wherein one of the conduit sections includes a transparent portion.

16. The deflector of claim 14, wherein the cup-like cap includes a transparent portion.

17. A deflector for removing particulate matter from the coolant system of an internal combustion engine and being connectable in a hose of the coolant system, the deflector comprising:

an upper conduit section with inlet and outlet ends, the ends being connectable into the hose of the coolant system, the upper conduit section having an inner wall defining a flow passage, a portion of the upper conduit section being transparent, a lower conduit section with a lower end and depending obliquely from the upper conduit section so that the conduit sections form generally the shape of a Y, a portion of the lower conduit section being transparent, removable collector means connected to the lower end of the lower conduit section for collecting and removing particulate collected in the lower conduit section, a portion of the removable collector means being transparent, a corner portion formed by the upper and lower conduit sections whereby the corner portion creates eddy like fluid flow to slow down the rate of fluid and particulate flow so that particulates settle into and are collected by the lower conduit section for removal, and the upper conduit section including a raised portion extending from the inner wall and partially into the flow passage to contribute to the eddy like fluid flow, the raised portion being disposed wholly between the corner portion and the outlet end.

18. A deflector for removing particulate matter from the coolant system of an internal combustion engine and being connectable in a hose of the coolant system, the deflector comprising:

an upper conduit section with inlet and outlet ends, the ends being connectable into the hose of the coolant system, the upper conduit section having an inner wall defining a flow passage, a lower conduit section with a lower end and depending from the upper conduit section, removable collector means connected to the lower end of the lower conduit section for collecting and removing particulate collected in the lower conduit section, a corner portion formed by the upper and lower conduit sections whereby the corner portion creates eddy like fluid flow to slow down the rate of fluid and particulate flow so that particulate settle into and are collected by the lower conduit section for removal, and the upper conduit section including a raised portion extending from the inner wall and partially into the flow passage to contribute to the eddy like fluid flow, the raised portion being disposed wholly between the outlet end and the corner portion, the raised portion including an upright wall for directing particulate matter back against the flow of fluid and into the lower conduit section, the upright wall including an upper linear edge, the edge intersecting the inner wall to form an arc of less than 180°.

19. A deflector for removing particulate matter from the coolant system of an internal combustion engine and being connectable in a hose of the coolant system, the deflector comprising:

an upper conduit section with inlet and outlet ends, the ends being connectable into the hose of the coolant system, the upper conduit section having an inner wall defining a flow passage, a lower conduit section with a lower end and depending from the upper conduit section, removable collector means connected to the lower end of the lower conduit section for collecting and removing particulate collected in the lower conduit section, an interior curved edge formed by the upper and lower conduit sections, the interior curved edge having a first corner portion disposed closer to the inlet end than the outlet end and a second portion disposed closer to the outlet end than the inlet end, the portions creating an eddy like fluid flow to slow down the rate of fluid and particulate flow so that particulates settle into and are collected by the lower conduit section for removal, and the upper conduit section including a raised portion extending from the inner wall and partially into the flow passage to contribute to the eddy like fluid flow, the raised portion being disposed wholly between the first corner portion and the outlet end.

20. A deflector for removing particulate matter from the coolant system of an internal combustion engine and being connectable in a hose of the coolant system, the deflector comprising:

an upper conduit section with inlet and outlet ends, the ends being connectable into the hose of the coolant system, the upper conduit section having an inner wall defining a flow passage, a lower conduit section with a lower end depending obliquely immediately from the upper conduit section, the lower conduit section being disposed at an acute angle of approximately 70° relative to the inlet end of the upper conduit section, removable collector means connected to the lower end of the lower conduit section for collecting and removing particulate collected in the lower conduit section, a corner portion formed by the upper and lower conduit sections whereby the corner portion creates eddy like fluid flow to slow down the rate of fluid and particulate flow so that particulates settle into and are collected by the lower conduit section for removal, and the upper conduit section including a raised portion extending from the inner wall and partially into the flow passage to contribute to the eddy like fluid flow the raised portion being disposed wholly between the lower portion and the outlet end.

* * * * *

UNITED STATES PATENT AND TRADEMARK OFFICE

CERTIFICATE OF CORRECTION

PATENT NO. : 4,949,682

DATED : August 21, 1990

INVENTOR(S) : Michael E. Klein

It is certified that error appears in the above-identified patent and that said Letters Patent is hereby corrected as shown below:

Column 9, line 21, delete "particulate" and replace it with --particulates--.

Column 10, line 8, after "the" and before "portions", insert --corner--.

Column 10, line 25, after "end" and before "depending", insert --and--.

Signed and Sealed this

Thirty-first Day of December, 1991

*Attest:*

HARRY F. MANBECK, JR.

*Attesting Officer*

*Commissioner of Patents and Trademarks*